United States Patent [19]

Marks

[11] 4,165,757

[45] Aug. 28, 1979

[54] ARCH SUPPORTED TENT

[75] Inventor: George R. Marks, Richmond, Calif.

[73] Assignee: Sierra Designs, Oakland, Calif.

[21] Appl. No.: 872,630

[22] Filed: Jan. 26, 1978

[51] Int. Cl.[2] ..... A45F 1/16; E04B 1/347

[52] U.S. Cl. ..... 135/1 R; 135/3 E; 135/15 CF; 135/DIG. 1

[58] Field of Search ..... 135/1 R, 3 E, 34, 36 F, 135/15 CF

[56] References Cited

U.S. PATENT DOCUMENTS

| | | | |
|---|---|---|---|
| 1,007,320 | 10/1911 | Wurster | 135/36 RT |
| 2,527,729 | 10/1950 | Hoff | 135/15 CF X |
| 3,534,750 | 10/1970 | Kolozsvary | 35/15 CF X |
| 3,834,410 | 9/1974 | Leibel | 135/3 E |
| 3,886,961 | 6/1975 | Geiger et al. | 135/1 R |
| 3,970,096 | 7/1976 | Nicolai | 135/14 V |
| 4,078,572 | 3/1978 | Moss | 135/1 R |

OTHER PUBLICATIONS

Jansport 1976 Catalog, pp. 10–12, (Jansport Paine Field, Industrial Park, Everett, Wash.).
Jansport 1977 Catalog, pp. 30–35.
The Ski Hut 1977 Catalog, p. 27 (1615 Univ. Ave., Berkeley, Calif. 94701).
Time Magazine, Jul. 26, 1977.
North Face Catalog, Sep. 1975.
Early Winters, Ltd. Catalog, Seattle, Wash. (1977).
Tents Works, Camden, Maine, Oct. 1977.

*Primary Examiner*—C. J. Husar
*Assistant Examiner*—Conrad L. Berman
*Attorney, Agent, or Firm*—Phillips, Moore, Weissenberger, Lempio & Majestic

[57] ABSTRACT

A double walled tent is supported by outwardly leaning pairs of arches and an interconnecting flexible ridge member. The ridge member is associated with the outer wall or cover, so that the outer wall may be tensioned to form the shelter. An inner wall or cover is suspended from the outer wall by netted webbing which allows circulation between the walls.

20 Claims, 12 Drawing Figures

ARCH SUPPORTED TENT

BACKGROUND OF THE INVENTION

This invention relates to a camping tent supported by arch structures. In particular, the invention relates to a tent having an outer wall supported by pairs of arches, the pairs of arches separated by a ridge member, so that an inner wall may be suspended from the outer wall.

Tents or shelters are made in many shapes and run the range from light weight tents, capable of being packed by one man to relatively cumbersome large tents requiring vehicle transport. The particular tent described herein in two embodiments, is of a size and weight such that a single man may pack it in a conventional backpack or the like to provide remote shelter of upwards of 4–6 individuals in one embodiment.

A tent should provide effective shelter in all climates. The tent must also allow for ventilation for the users. Although tent walls (which hereafter includes the roof or cover portion) can be made moisture proof, the general procedure is to permit the tent structure to "breathe". This provides a degree of water repellency without condensate forming on the inner surface. A water proof outer cover, or what is known as a "fly" may then be added to the structure for use in snow or rain conditions to effectively water proof the tent. Nevertheless, some conventional tent structures may accumulate condensate on the inner side of the outer wall or fly if ventilation between the two walls is not provided.

One problem, which is present in the design and structure of all tent structures, is stability under high wind conditions. Rudimentary tents generally utilize pegs at each corner and a plurality of guy lines which may be tensioned to outlying pegs or the like in order to provide structural integrity. Guy lines, running to outlying pegs suffer the obvious disadvantage of coming loose, either by the tent working in the wind or by the camper tripping over the peg or the line during hours of darkness.

All tents utilize some sort of a pole structure which, when assembled, forms a skeleton upon which the fabric covering may be suspended or supported. The pole structure also may be supported by a plurality of guy lines even in advanced designs in the manner of the more rudimentary tents. Furthermore, all tents include some means to anchor the tent to the terrain. Such anchor means may be pegs or guy lines and pegs.

Some tents are bowed arches which overlap one another. Some of these tents place the arches on an angular orientation to the ground and further place the cover or wall under tension. It has been found that the pointed arch commonly called the Gothic or lancet arch is stronger than the presently used round or bowed arch when made of flexible tubing. This has been made possible in part by use of a rigid fitting interconnecting the two legs of the arch.

Certain tents are able to eliminate the guy line structure entirely and depend generally upon tension within the pole structure. The tension is usually provided by bending the poles while suspending the tent from some sort of an upstanding fabric web or the like through which the bent pole is passed. In such an arrangement, the so called "fly" is usually a separate entity so that the fly may be positioned above and resting on the upstanding webs.

The "fly" is the water proof member thus avoiding condensate forming on the inner surface of the inner wall. Collected condensate on the inner wall is undesirable from many points of view. Initially, it is uncomfortable to spend prolonged periods of time in a damp structure. In low temperature conditions the condensate may freeze and act to conduct heat out of the tent thus negating part of the advantages of a tent. When the tent is struck following a camping period, the condensate remains and a wet tent is packed in the backpackers pack. Although a water proof "fly" may overcome some of these disadvantages, others remain.

The fly is advantageous in any tent and becomes almost a necessity in cold weather conditions wherein the additional insulation of the dead air space may be utilized. However, the fly structure in the conventional backpacking tent requires additional space and furthermore requires additional time to assemble since it is usually not integrally formed with the tent. Therefore it becomes a disadvantage which must be weighed by the camper in the decision on what to carry.

Ease of assembly is important to the backpacker and becomes of paramount importance in a cold mountain environment. In short, it is vital to be able to assemble a tent in the shortest possible time and with greatest ease. A mountain climber quite frequently cannot remove his mittens or gloves for prolonged periods for fear of frostbite, therefore a tent which may be assembled rapidly and preferably with the hands still encased in mittens or gloves is of prime value.

Many tents require the user to anchor the floor structure to the terrain through the use of pegs or the like during the assembly process. This can be a serious drawback in cold weather conditions. Therefore a tent which may take on its general structural shape during the assembly and installation of the various structural poles without the absolute necessity of anchoring the floor to the ground may be highly desirable. In such a structure, the user may assemble a tent, then temporarily anchor the tent to the terrain by placing his or her pack on the floor followed by positioning of additional anchors at the corners of the tent. Such anchors may be pegs or the like. Portability of the tent when assembled in a distinct advantage, in that the orientation of the tent may be rapidly changed under a changing weather condition since the structure of the tent is not violated when the anchoring devices are removed from the terrain.

In many presently available tents, the user is restricted in that he or she dare not lean against the structure of the tent in its assembled state. One reason for such a restriction is moisture or condensate on the inner wall of the tent. A more serious reason is the structural integrity of the tent may be threatened by a camper leaning against a wall and forcing the wall in a direction it is not designed to be stressed. The result may be a collapsed tent under less than good conditions. Thus the camper is restricted in most tent structures to sitting upright without leaning against the walls of the tent.

Ventilation in tents is important, and may be provided by an open door. However, open door type ventilation allows for ingress of insects such as mosquitoes, flies, and the like. Accordingly it is common to utilize insect netting in existing backpacking tents. One convenient way of providing insulation in a two man tent is through the use of insect netting at the front and back walls. Since one of the two of the front or back walls must be utilized as an entrance, the common method is to provide a water proof flap and an insect net both formed in the outer structure of the tent. Thus when the occupant wishes to enter or leave the tent he generally must unfasten both the entrance flap and the mosquito netting or leave one or the other rolled up and out of use. This may prove inconvenient to the user.

It was these disadvantages found in the present tents that formed the basis for the invention of the present structure.

SUMMARY OF THE INVENTION

This invention provides structure for a tent which overcomes the disadvantages set forth above while providing additional advantages not previously mentioned.

It is an object of this invention to provide paired arches for support of a double walled tent.

It is also an object of this invention to provide the tent as set forth above wherein the arches are of the Gothic type.

It is also an object of this invention to provide a tent using the paired arch structure set forth above in conjunction with a tensioned outer wall and a ridge member to provide structural integrity to the tent.

It is a further object of this invention to provide the tent as set forth in the above objects wherein the outer wall is tensioned in conjunction with the ridge member.

It is still a further object of this invention to provide the tent as set forth in the above objects wherein the paired arches lean outwardly.

It is a further object of this invention to provide the double walled tent as set forth above wherein air may circulate freely between the inner and outer wall.

These and other objects of the invention will become apparent from a study of the accompanying drawings and the following specification.

Broadly stated the invention is a tent having an outer and inner cover. The tent is supported by first and second arch assemblies removably associated with the outer cover and adjacent opposite edges thereof. The apexes of the first and second arch assemblies are positioned generally at the midpoint of the opposite edges. A ridge member is removably associated with and cooperates with the outer cover for spatially separating the first and second arch assemblies in an outwardly divergent relation so that the outer cover forms a shelter. Means for suspending the inner cover from the outer cover are also provided.

DETAILED DESCRIPTION OF THE VARIOUS EMBODIMENTS

Figure 1:
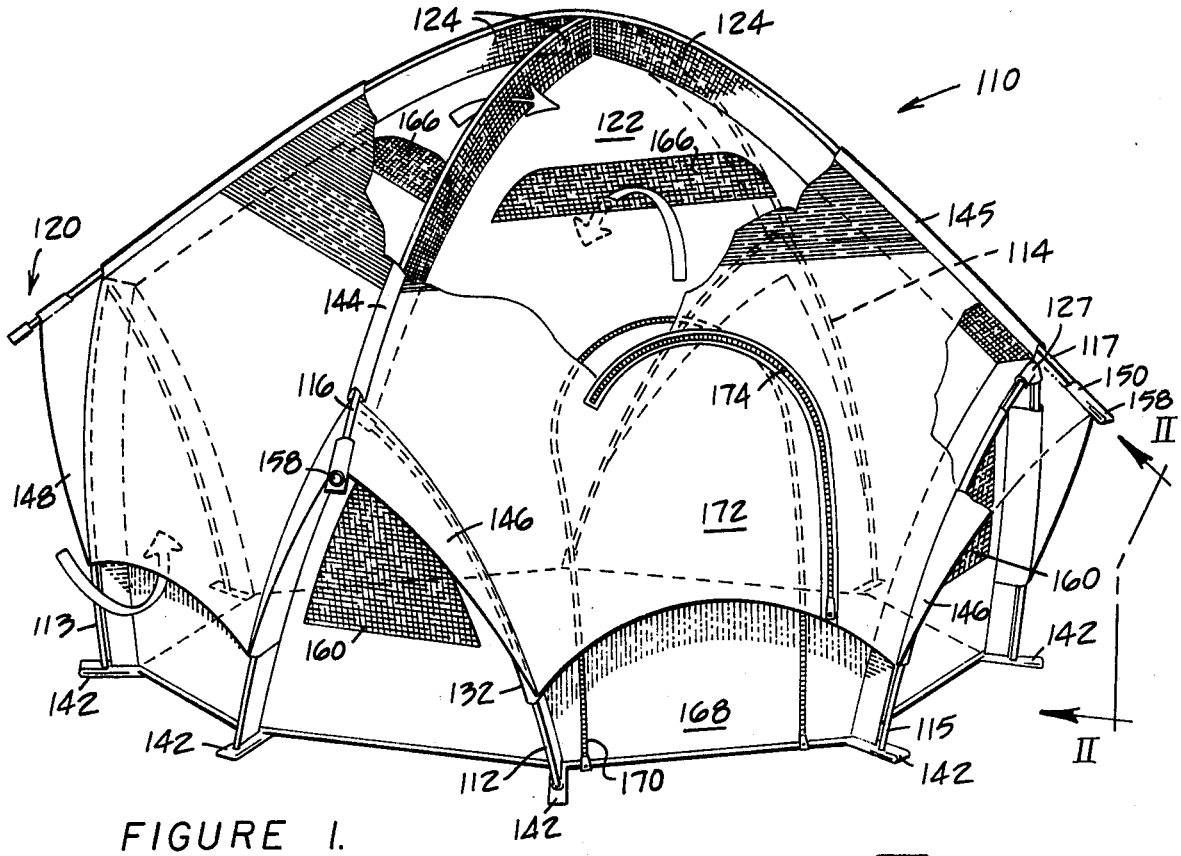
FIG. 1 is a perspective view partly broken away of one embodiment of the tent described in the following specification.
Figure 2:
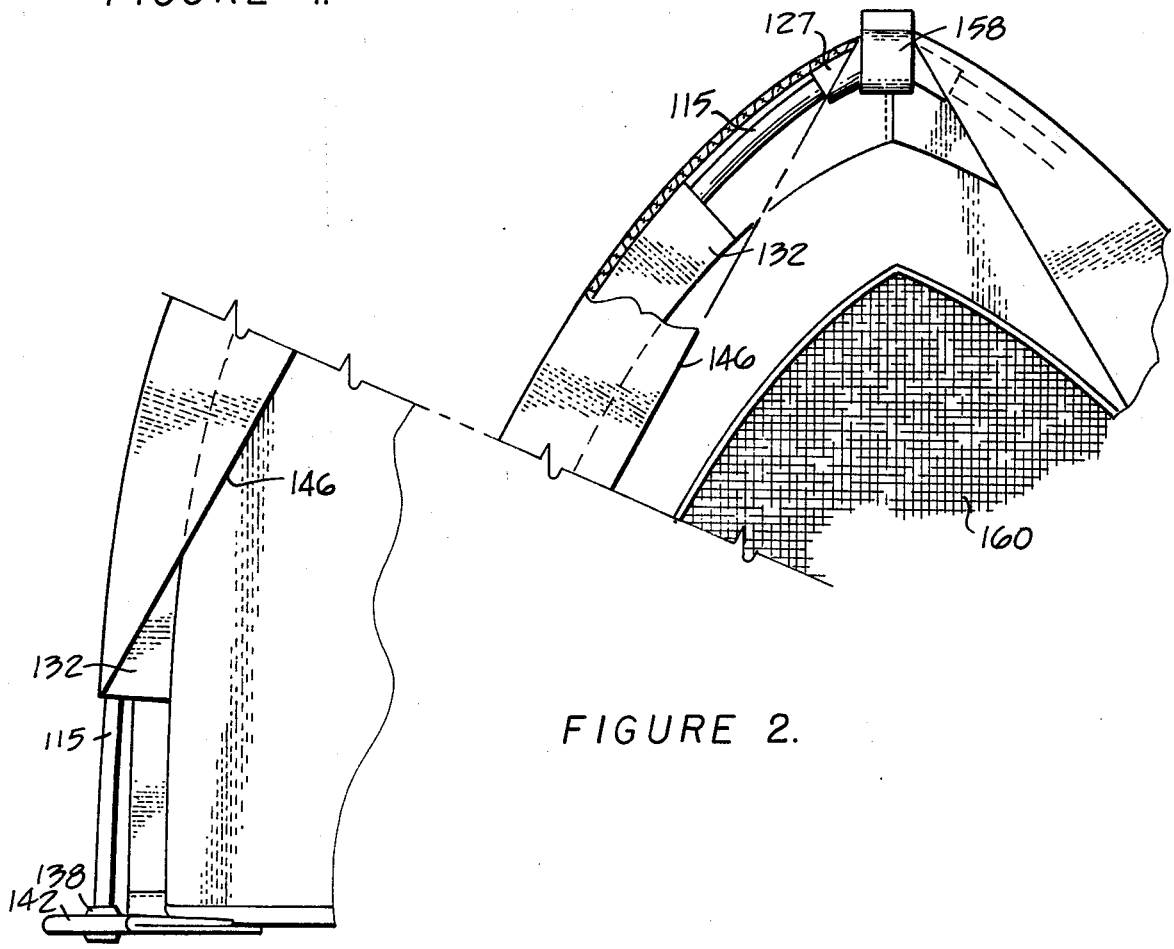
FIG. 2 is an elevational view taken at the view line II—II of FIG. 1 of the embodiment depicted in FIG. 1.
Figure 4:
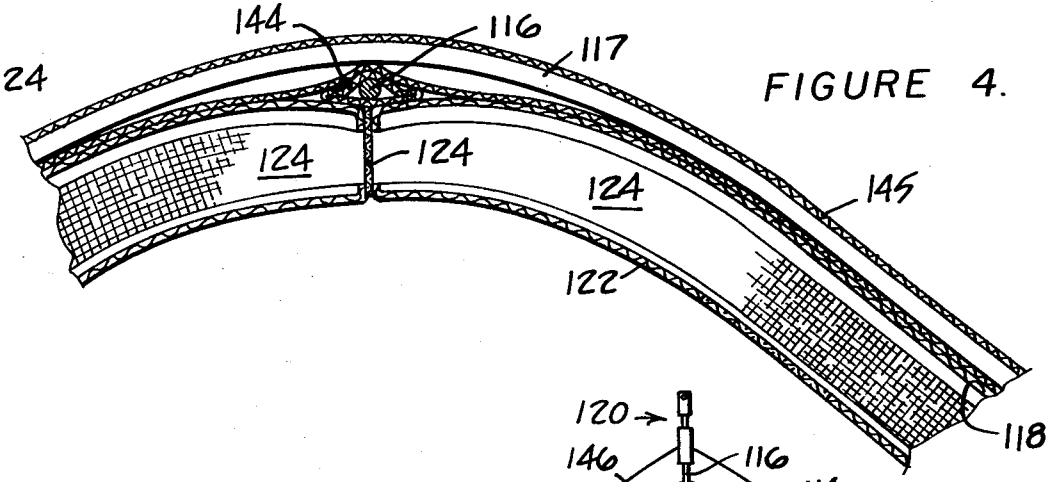
FIG. 4 is a sectional view of the tent depicted in FIG. 3 taken at section line IV—IV.
Figure 3:
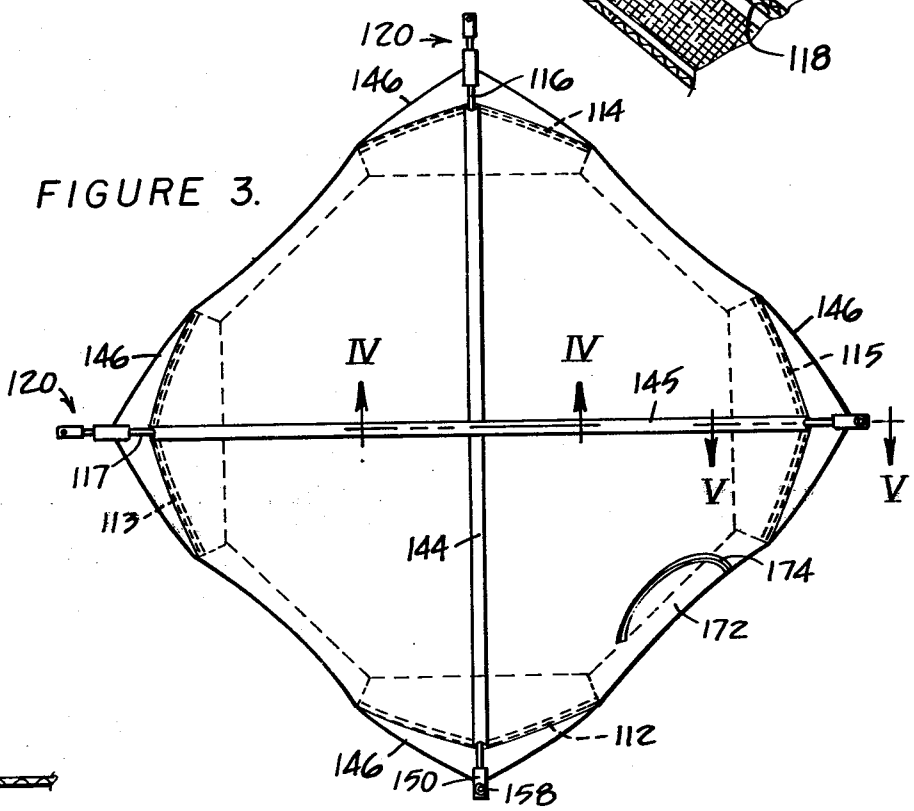
FIG. 3 is a top plan view of the tent depicted in FIG. 1.
Figure 6:
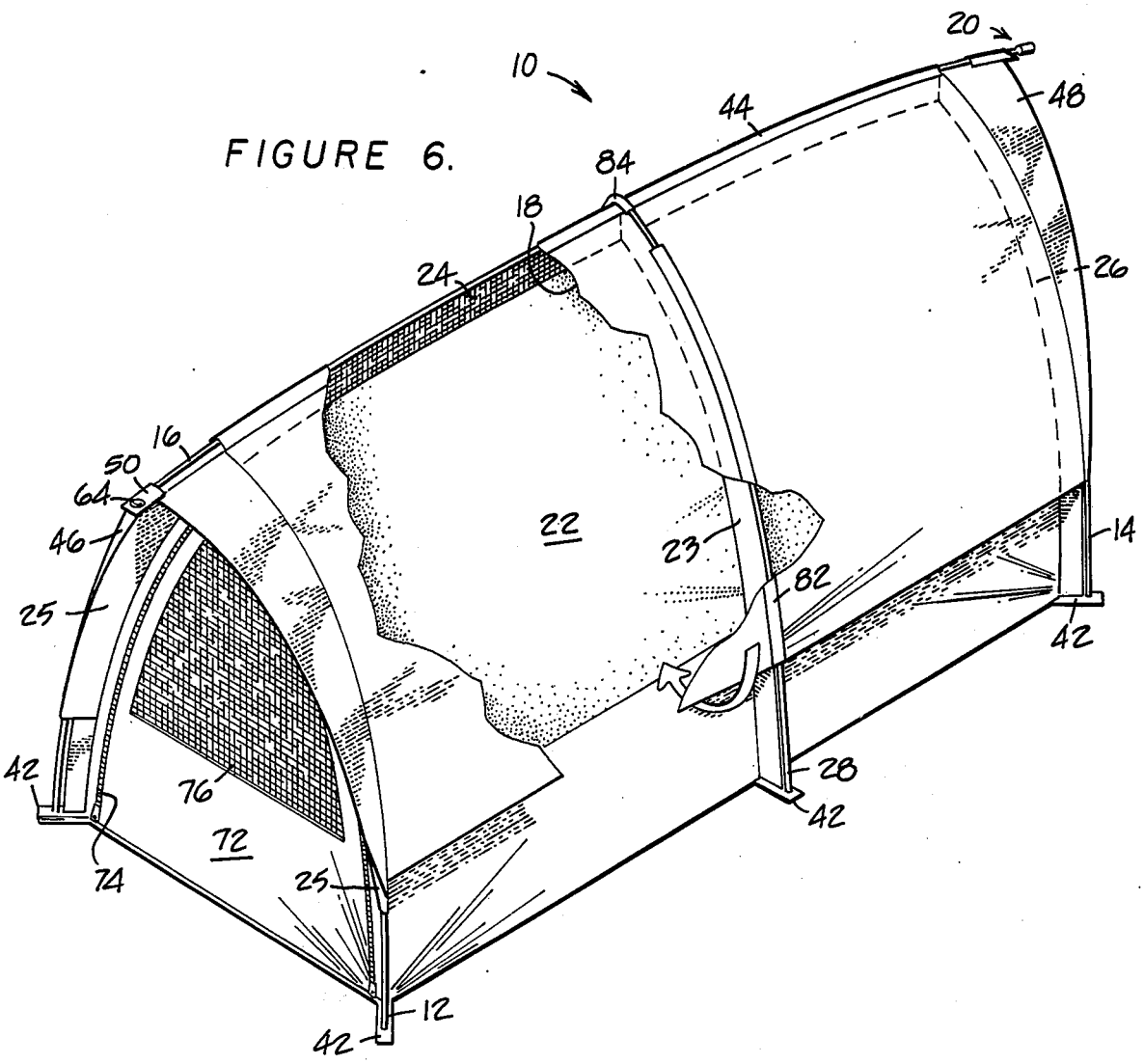
FIG. 6 is a perspective view partly broken away of a second embodiment of the tent described in the following specification.

It should be noted that the following specification describes two embodiments generally indicated in FIGS. 1 and 6 respectively. It is important to understand that the structural features forming the tent support are applicable to both embodiments. Accordingly, reference is first made to FIG. 6 which is the simpler of the two embodiments.

The term "stitch" is used generically in this specification to include seams formed by a sewing machine and also to include other methods of affixing fabrics together such as by bonding, hand sewing, fusing or the like.

The First Embodiment

A double walled tent, 10, is shown in perspective in FIG. 6. Double walled tent 10 is supported by two outwardly leaning arch assemblies 12 and 14, which are maintained in a spatially separated condition, with the tent assembled, by ridge means such as a flexible ridge member 16 which cooperates with an outer cover 18 by means of a tensioning assembly 20 (see FIGS. 9 and 12) to establish the three dimensional shape.

Outer cover 18 is generally polygonal in shape and has at least two opposed edges at opposite ends or sides thereof. In this embodiment the outer cover 18 is generally rectangular.

Figure 8:
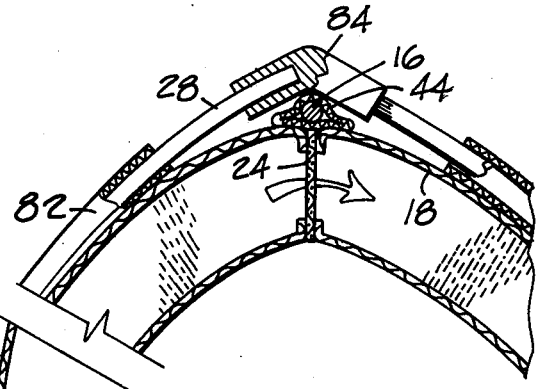
FIG. 8 is a partial sectional view of the tent depicted in FIG. 7 taken at section line VIII—VIII.
Figure 8:
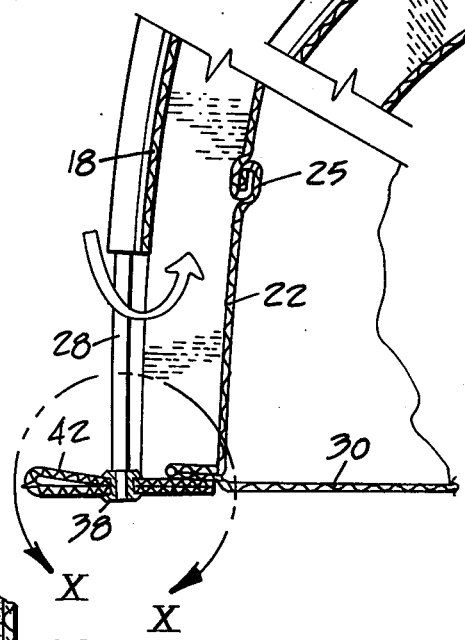

Suspended from the outer cover 18 is an inner cover 22 forming the second wall of the double walled tent. The inner cover 22 is suspended by a webbed portion 24 affixed or stitched along one edge to the outer cover 18 in general alignment with the flexible ridge member 16. The other edge of the web portion is stitched to the inner cover 22. The web portion 24 may be made of a net fabric in order to provide air circulation as indicated in FIG. 8.

Second web portions 25 and 26 interconnect the outer cover 18 with the inner cover 22 along a line with the first and second arch assemblies 12 and 14 respectively. The second web portions 25 and 26 may be formed of a relatively close weave material, wherein free communication of air is not inhibited.

The arch assemblies 12 and 14 are formed of a flexible material such as aluminum or the like, and are joined at the top by means of a relatively rigid coupling 27. It should be apparent from the drawings that the arch assemblies 12 and 14, are each affixed adjacent to the polygonal shaped outer cover 18 with the apexes of the arches generally at the midpoints of the respective opposite edges of the polygonal shaped outer cover 18. The arch assemblies are generally associated in the same manner with each end therefore, with reference to FIG. 7, only the arch assembly 12 will be described.

Before describing arch assembly 12, the center arch assembly 28 should be mentioned. This center arch assembly 28 offers little structural integrity to the double walled tent but rather serves primarily to maintain the tube like integrity of this particular embodiment.

Figure 10:
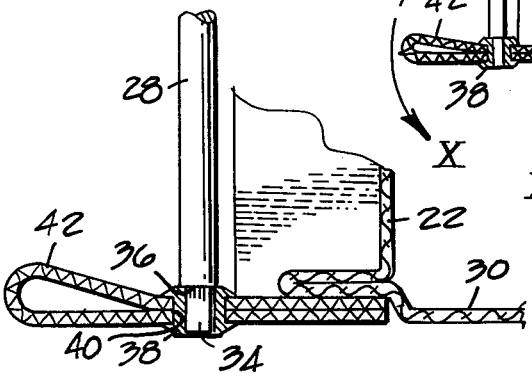
FIG. 10 is a detailed sectional view taken at view line X—X of FIG. 8 of a portion of the tent shown in FIG. 6.

The first and second arch assemblies, 12 and 14, cooperating with flexible ridge member 16, form the primary basis for support of the tent. The arches are removably associated with the tent in the manner shown in FIG. 11. The center arch assembly 28, which is shown in section in FIG. 10, illustrates the detail of how all three arch assemblies may be associated with inner wall 22 at the junction of the inner wall 22 and a floor 30 of this tent. Thus the detailed view in FIG. 10, which is taken at view line X—X of FIG. 8, is generally applicable to any of the intersections of the floor 30 and arch assembly 12, 14 or 28.

Figures 7, 12:
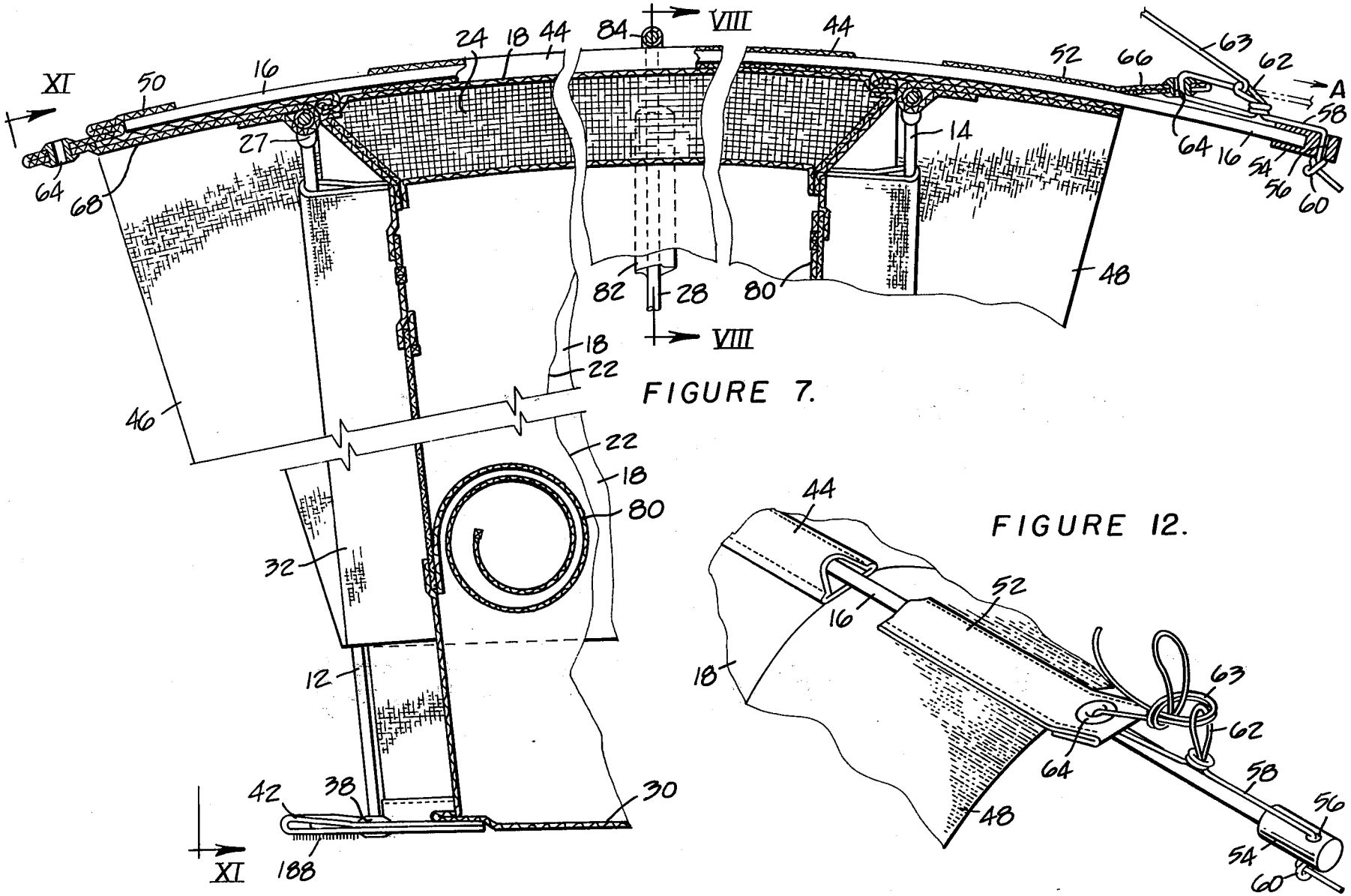
FIG. 7 is a side elevational view in section of the tent depicted in FIG. 6.
FIG. 12 is a perspective view of the tensioning arrangement shown in FIG. 7 at view line XII—XII and which may be used in both embodiments of this invention.
Figure 11:
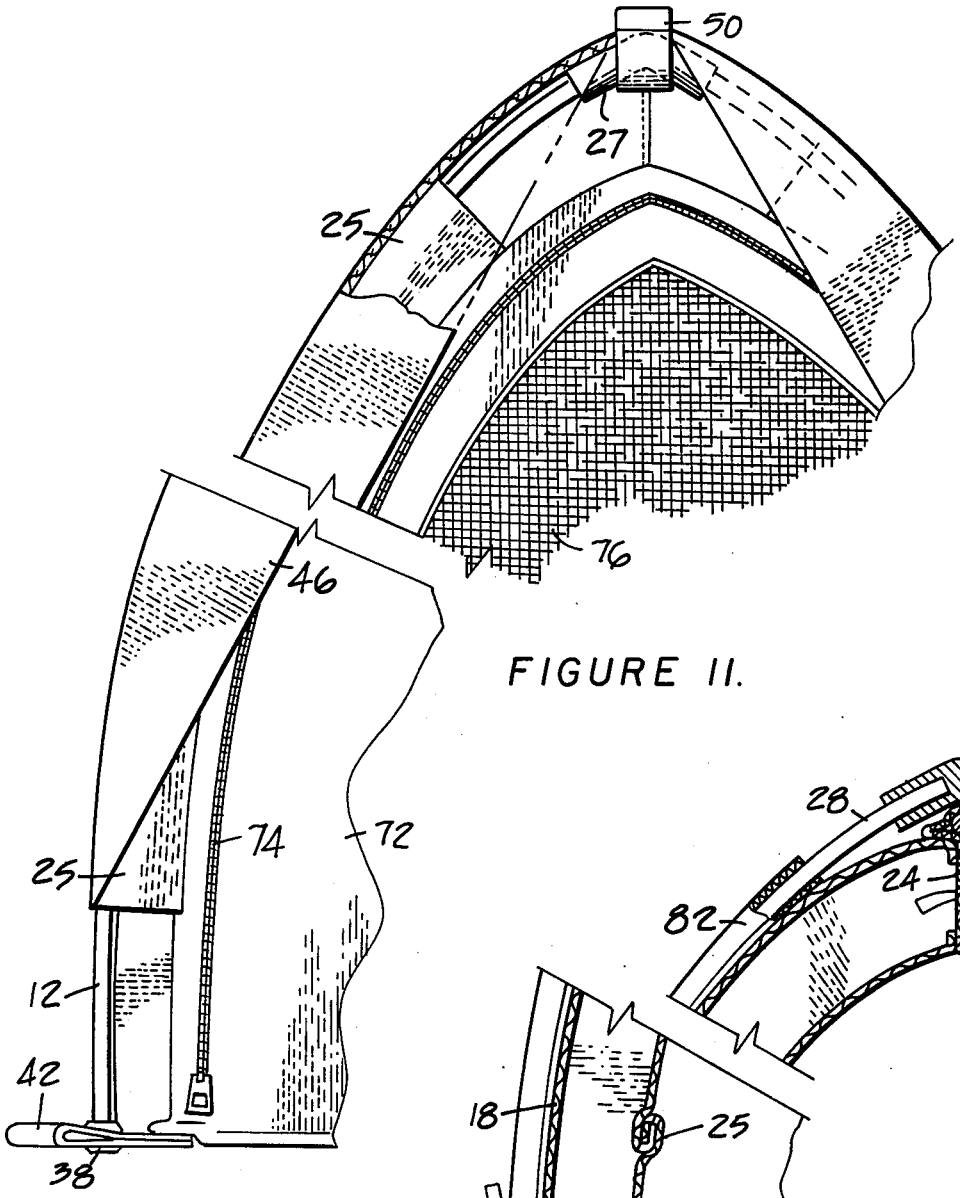
FIG. 11 is a partial end view of the tent depicted in FIG. 7 taken at view line XI—XI.

Referring again to the first and second arch assemblies, 12 and 14, it can be seen in FIG. 7 that these assemblies are positioned in fabric tunnels 32 formed in conjunction with the web portions 25 and 26. Since each of the first and second arch assembly 12 and 14 are formed with flexible legs interconnected by fitting 27, the legs may be positioned from either end of tunnel 32 as indicated in FIG. 11. Fitting 27 connecting the legs 33 of arch assembly 12 and 14 is below ridge member. On the other hand, the interconnecting fitting 84 of the center arch assembly 28 is above the ridge member 16 in in order to maintain the integrity of outer cover 18.

Each individual leg of each arch assembly such as the leg 33 shown in FIG. 10, is formed with a short extension 34 of smaller diameter than the leg itself. The intersection of the extension 34 with the leg 33 forms a shoulder 36 which may abut a grommet 38 disposed in a hole formed in a tab such as fabric extension 42 stitched to floor 30 at the intersection of the inner cover 22 and generally coincident with each leg of each arch assembly, in a manner similar to that shown in FIG. 10. The fabric extension 42 with the grommet 38 disposed therein is utilized at each point of intersection of the corresponding legs of the various arch assemblies.

Each leg of each arch assembly is made of a predetermined length so that in the assembled condition as shown in FIG. 11, the structure takes on the familiar pointed arch structure commonly known as either a Gothic arch or better defined as a lancet arch. As is well known to those skilled in the art, an arch structure has unique strength properties which need not be elaborated on this specification. Suffice it to say, the flexible legs of an arch structure such as arch assembly 12 take on rigidity when joined by fitting 27 and with the legs positioned in the appropriate grommets 37 and tunnels 32 so that each of the legs is bowed as indicated in FIG. 11.

The flexible ridge member 16 interconnects arch assembly 12 and arch assembly 14 in the manner best indicated in FIG. 7. Flexible ridge member 16 is positioned along the center or ridge line of the longitudinal axis of the outer cover 22 by means of a fabric tube 44 stitched to the outer cover. At the opposie edges or ends of the outer cover 22 where the first and second arch assemblies are positioned, two awning like extensions 46 and 48 generally in the form of an isosceles triangle are affixed. The apexes of the extensions 46 and 48 are adjacent to the ends of flexible ridge member 16 as indicated in FIG. 7. Affixed to one of the two extensions, for example, extension 46 is a short length of the fabric forming tube 50 which is closed at the end distal of the outer cover 18. Affixed to the other extension, such as extension 48, is a second short length of fabric forming tube 52 which is open at both ends.

It can be seen in FIG. 7 that flexible ridge member 16 may be passed through fabric tube 52 affixed to extension 48 and thence fabric tube 44, which is affixed to outer cover 18 and finally into fabric tube 50 to abut the closed end thereof. Ridge member 16 which may be formed in sections for ease of handling during backpacking, is purposely made longer than the sum of the longitudinal length of the outer cover 22 plus the height of the generally triangular shaped awning like extensions 46 and 48.

Ridge member 16, because of its extra length, may act in cooperation with the outer cover 22 for tensioning of the outer cover relative the ridge member. This may be accomplished in one of several ways. The preferred tensioning means is illustrated in FIG. 12. The flexible ridge member 16 is formed with an enlarged end 54 through which a transverse bore 56 is formed. A flexible member such as a tensioning line 58, which may be of synthetic material, passes through bore 56 and has formed at one end a knot 60 or the like to prevent the line 58 from completely passing through bore 56 when tension is placed on the bitter end thereof. The line 58 is formed with a bight 62 proximate the enlarged end 54. The bitter end 63 is passed through a grommet 64 placed in a fabric strap 66 stitched to the tent. Bitter end 63 may then be tensioned by pulling in direction A. When properly tensioned, bitter end 63 may pass through bight 62 and a round turn and a half hitch formed about the standing part of line 58 to secure the tensioning apparatus.

The fabric strap 66 as can be seen in FIG. 7, is stitched to extension 48 and generally coincident with the ridge line of the tent 10. A strap 68, similar to strap 66, is stitched at the other opposite end of tent to extension 46. It should be noted that the strap 68 stitched to extension 46 is not utilized for tensioning the ridge member, but rather may serve as an auxiliary tie-down point for the tent.

Tension on flexible ridge member 16, as just described, acts not only upon outer cover 22, but also upon extensions 46 and 48. By applying tension to extensions 46 and 48 the legs of arch assembly 12 are held in the spatially separated relationship to the legs of arch assembly 14. The separation is determined by the length of outer cover 22 separating the legs. The individual legs of each arch assembly 12 and 14, are separated laterally and held in the separated position by resiliency inherent in the individual legs as previously described. The tent 10 is formed so that arch assemblies 12 and 14 lean outwardly as shown in FIG. 7. The extensions 46 and 48, will act on each leg 33 to maintain this outwardly leaning posture while the ridge member 16 is under tension.

The tent, as described to this point, will remain in a tent like shape without further structure, however certain refinements may be used on the tent to further stabilize and weather proof the tent for use. In addition, certain other features increase the habitability factor in the tent described.

Referring to FIG. 6, fabric extensions 42 extend outwardly from the tent and may serve as tie-down points either for insertion of a peg or through the use of line.

Previously mentioned, was the center arch assembly 28 which serves to round out the shape of the tent. It should be noted that a web 23 between the outer cover 18 and the inner cover 22 connecting the outer cover to the inner cover and adjacent the center arch assembly may be made of a net-like material in manner of the web portion 24. This net-like material permits air flow between the right and left portions of the tent as shown in FIG. 6.

Although the upper portion of the inner cover 22 is made of a permeable fabric to permit the tent to breathe, the lower portion of the inner cover is preferably made of a water proof fabric of the type used for the outer cover 18. Similarly the floor 30 is made of a water proof material. Referring to FIG. 8, a seam 25 fixing the water proof fabric to the permeable fabric of the inner cover 22, can be seen above the lower edge of the outer cover 18. This provides a splash proof surface in the event the tent is utilized in inclement weather.

Referring again to FIG. 6, it can be seen that the tent is formed with a front panel 72 which may be fastened to inner cover 22 by a slide fastener such as zipper 74. Formed in front panel, 72, is a net panel 76. Net panel 76 is backed by a fabric panel 78, shown rolled in FIG. 7 and generally of a shape of net panel 76. The fabric panel 78 may be rolled down as shown in FIG. 7 and tied in the rolled down position to allow air to pass through net panel 76. Similarly the fabric panel 78 may be unrolled and fastened to the front panel 72 by a slide fastener or the like to block air flow through the net panel 76. This provides a unique advantage, in that the net panel 76 may remain open while the front panel 72, which forms a door, is closed. In many previous tents, the net panel and the fabric door have been made as two separate members so that either the net panel is used as the door or the fabric panel is used as the door. Although not specifically shown, a similar net panel to net panel 76 can be formed in the rear wall of the tent shown in FIG. 6.

Referring again to FIG. 8, it should be pointed out that the center arch assembly 28 passes above the flexible ridge member 16. Although the center arch assembly is not absolutely essential to the structure of this tent, the center arch assembly does serve to assist in maintaining the convex bow of the flexible ridge member. This convex bow will nevertheless occur even without the center arch assembly 46 and 48.

The center arch assembly 28 passes through a fabric tube 82 and is interconnected at the top by the fitting 84 similar to the fitting 27 utilized to interconnect the first and second arch assemblies 12 and 14 respectively. It should be noted that the fabric tube 82 is terminated short of the apex or the ridge line of the tent as indicated in FIG. 8. Thus the individual legs of the center arch assembly may be passed through the tubes and into the respective grommets 38 in extensions 52 while simultaneously interconnecting one with the other through fitting 84.

Operation of the First Embodiment

Although it should be apparent to those skilled in the art, it is appropriate to elaborate on how the tent is used in operation.

The tent, of course, will ordinarily be carried in a backpack during a camping period. When use becomes necessary, the user will unpack the fabric portion of the tent along with the various legs of the arch assemblies and the flexible ridge member 16. It should be noted that the central arch assembly 28 is somewhat longer than the first and second arch assemblies 12 and 14, therefore the user will first pick the shorter pair of legs forming the arch members 12 and 14 and insert the legs through the respective tunnels 32 which open at the top and the bottom. The fitting 27 may be permanently fixed to one of the two legs of the individual arch assembly and serves to fix the two legs into the arch shape. The small extension 34 of each leg is positioned into grommet 38 in each individual extension 42 after the legs of the arch assemblies are positioned in the tunnels 32 and interconnected by fitting 27.

The flexible ridge member 16 may then be assembled if it is formed in sections. This sectional construction has been found convenient to shorten the length of the member. It may come in 2,3, or 4 sections as appropriate. The flexible member 16, once in its fully extended assembled condition, may then be passed through fabric tube 52 on extension 48, then through fabric tube 44 for seating in the fabric tube 50 as indicated in FIG. 7. Once the flexible ridge member 16 is so positioned, the tent may be generally held up by the user until the tensioning device is utilized to place tension on the outer cover. Concurrently the center arch assembly 28 may be installed through the tubes 82 to give general rigidity to the tent structure itself. Once the tent is tensioned, the user may then anchor the tent at its four corners as appropriate.

The Second Embodiment

The second embodiment depicted in FIGS. 1-5 is similar in construction to the previously described embodiment in that it also contains a flexible ridge member and a pair of arch assemblies. In addition, a second flexible ridge member substantially perpendicular to the first flexible ridge member and a second pair of arches are added to the tent. It is pointed out that the arches, which in the first embodiment are positioned at opposite edges of the generally rectangular outer cover, are similarly positioned at opposite edges of this generally octagonally shaped outer cover of this second embodiment.

Elements which correspond between the two embodiments will generally be identified by adding one hundred to the number in the first embodiment. Elements dissimilar from the previously described embodiment will be renumbered in the following description. Duplicate or similar elements in this embodiment will normally carry the same number.

Referring to FIG. 1, a double walled tent 110, is illustrated. Double walled tent 110 is comprised of an inner cover 122, suspended from an outer cover 118 by netted webbing members 124. Supporting the outer wall is a first pair of arch assemblies 112 and 114. Interconnecting this first set of arch assemblies is a flexible ridge member 116. The first arch assembly 112 is positioned adjacent to one edge of outer cover 118 in a fabric tunnel 132. The opposite arch 114 is contained in a similar fabric tunnel 133 as shown in FIG. 5.

Flexible ridge member, 116 is contained in a fabric tunnel 144 which passes through the center point of the generally octagonal shaped outer cover 118. Flexible ridge member 116 is affixed at one end adjacent to arch assembly 112 in a fabric tube 150, which is stitched to an awning like extension 146, overhanging the arch structure 112. A tensioning assembly 120 similar to that depicted in FIG. 12 and described in the first embodiment may be affixed to an awning like extension 148 for use at the other opposite end of the flexible ridge member 116. It is, of course, understood that the flexible ridge member 116 may be jointed for ease of packing. During operation the jointed flexible ridge member 116 is formed into one continuous pole as indicated in FIG. 1.

Positioned 90° from the first and second arch assemblies 112 and 114 are similar, third and fourth arch assemblies, 113 and 115 respectively interconnected to a second flexible ridge member 117 substantially identical in construction to the first flexible ridge member 116. As can be seen in FIG. 5, the construction and positioning of arch assembly 115 and similarly, arch assemblies 112 through 114 in relation to the flexible ridge members 116 and 117 is substantially identical to the construction and positioning of the flexible ridge member 16 shown in FIG. 7 in relation to the arch assemblies 12 and 14 of the previously described embodiment. It is pointed out that the arch assemblies described in the first embodiment and the arch assemblies in the present embodiment, lean outwardly in the manner depicted in the drawings. Similarly, the respective arch assemblies are positioned relative a fabric extension 142 in this second embodiment and the similar fabric extension 42 in the first embodiment by means of a grommet 138 in this embodiment and grommet 38 in the earlier embodiment. The individual arch assemblies are made up of pairs of flexible members or legs made of metal of the like and interconnected to the top by a fitting 127. The ends of the legs of the arch assemblies are formed with shoulders substantially identical to the structure shown in FIG. 10. It may therefore be said that the arch assemblies 12 and 112, for example, could be interchanged.

Figure 5:
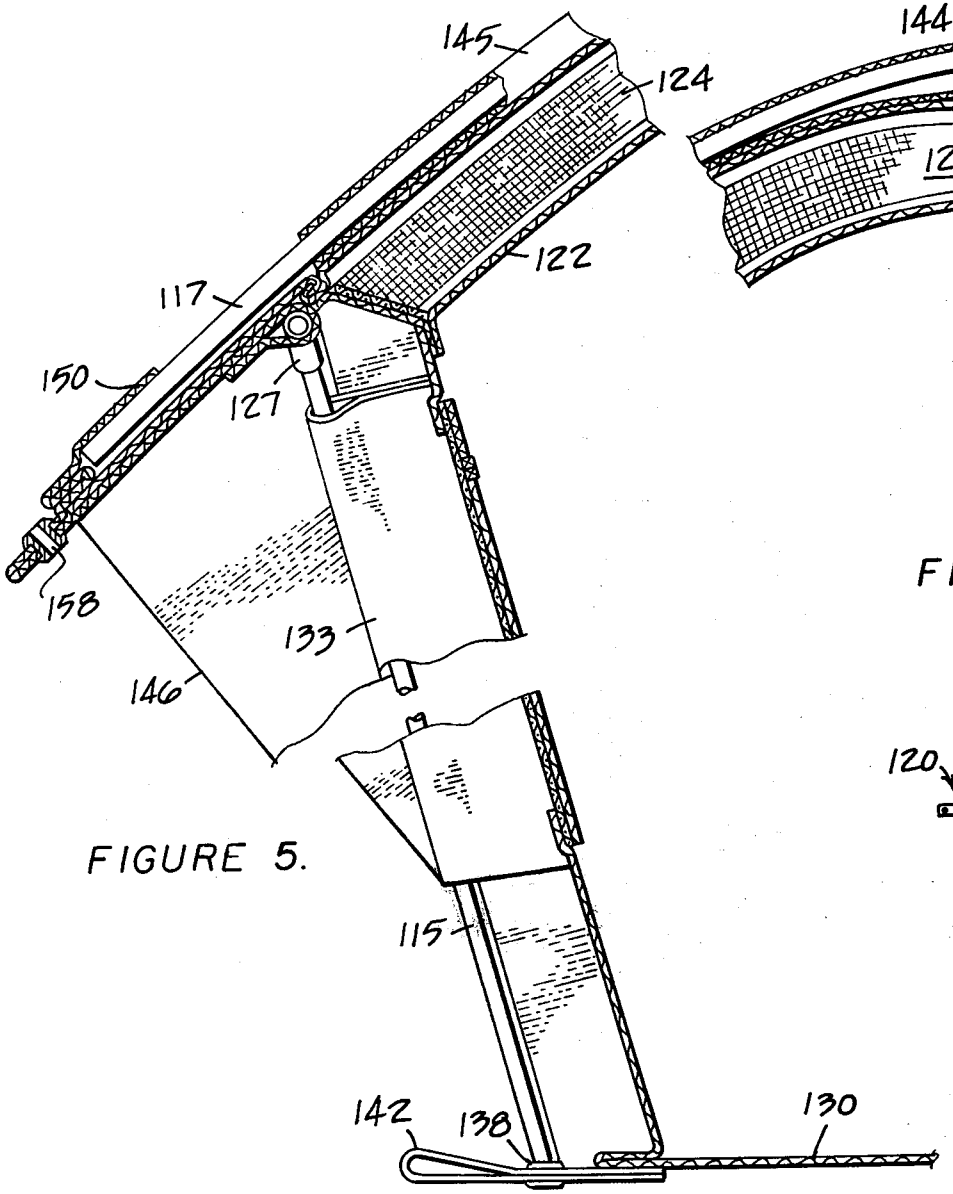
FIG. 5 is a partial sectional view of the tent depicted in FIG. 3 taken at section line V—V.

The flexible ridge member 117 is positioned in a fabric tunnel 150 which is closed at one end as indicated in FIG. 5 and which is stitched to an awning like extension 14 stitched to the edge of the generally octagonal outer cover 118. Extension 146 serves to tension the arch assembly outwardly as indicated in FIG. 5, and also serves to protect the interior of the tent from inclement weather in the same manner as in the first embodiment.

The inner cover 122, in the present embodiment, may be formed with a net covered window 160 formed in the portion between the legs of each individual arch assembly. It may be appropriate to provide a rolled down permeable fabric cover for the net window 160 to block out rain and the like in the event of inclement weather.

Similarly the tent has a floor 130, which is of water proof material and extends upwardly as a portion of the inner cover 122 to a seam 164 generally above the lower edge of the outer cover 118. As with the first embodiment, the inner cover 122 is preferably manufactured of a permeable fabric in the upper portion while the lower portion is water proof. The outer cover 118 is of a water proof material, and is purposely made with its upper half of a darker material. The darker material serves two useful purposes. The first being to shade the interior of the tent during daylight hours. This is particularly useful at high altitudes where light intensity may be considerably stronger than at sea level due to the lack of pollutants in the the atmosphere and a less dense atmosphere. The second useful purpose is the darker upper surface will absorb a certain amount of heat thereby assisting in raising the interior temperature of the tent during sunlit hours.

This embodiment is also provided with the netted web portions 124 similar to web portions 24 described in the previous embodiment. Web portions 124 suspend the inner cover 122 from the outer cover 118. In addition, the inner cover 122 may be formed with netted vents 166 to permit air flow between the interior of the tent structure and the space between the inner and outer cover.

The present embodiment is provided with means for entrance and egress by a door 168 interconnected with the inner cover 122 by a slide fastener such as zipper 170. It should be noted that door 168 may be positioned between two arch structures rather than coincident with an arch assembly as in the first embodiment to avoid the possibility of an occupant from contacting the ridge members upon entrance. An opening 172 may be provided in the outer cover 118 coincident with door 168 and also is closable by a slide fastener 174. It should be noted that positioning the door as indicated in FIG. 1 permits leaving the ventilation openings 160, which are covered with insect netting, in place at all times, thus ventilation is not impeded by the door.

Operation of the Second Embodiment

In operation, this tent is similar to the first embodiment, wherein assembly is eased by the use of the tensioning members which effectively raise the tent from a packed condition to a usable condition. It is further noted that the strength inherent in the arch structure pointed out in the first embodiment is also carried out in the second embodiment.

The flexible ridge members 116 and 117 in the second embodiment are purposely bowed a greater amount that in the first embodiment in order to provide more head room for the occupants in the tent.

Assembly of this embodiment may be accomplished by first inserting the arch legs in their respective tunnels and then connecting the individual legs of the four arch assemblies. Next the flexible ridge members 116 and 117 may be passed through their respective fabric tubes 144 and 145 to abut the closed end of fabric tube 150. Finally, the two tensioning devices 120 may be used in the manner described above to tension the ridge members. This step may be followed by pegging the tent to the terrain. Pegging may be accomplished by use of grommets in extensions 142 (not shown) or by short lengths of line affixed to the extensions 142 for tying to pegs.

One important feature of both embodiments is the capability of leaning against the fabric between the legs of the arch members without unduly hazarding the tent itself. This is attributable to the outwardly leaning arch assemblies.

It is pointed out, the second embodiment may be formed with grommets (not shown) in the extensions 142 in order to tie the tent to the terrain and also grommets 158 on the extensions 146 affixed to the outer cover in the proximity of the first and third arch assemblies 112 and 113. Since the flexible ridge member is formed with an eye as indicated in FIG. 12, the same eye or the enlarged end may also be used to fasten the tent in proximity of the second and fourth arch assemblies 114 and 115. It is emphasized that such additional tie-down is not ordinarily needed.

Figure 9:
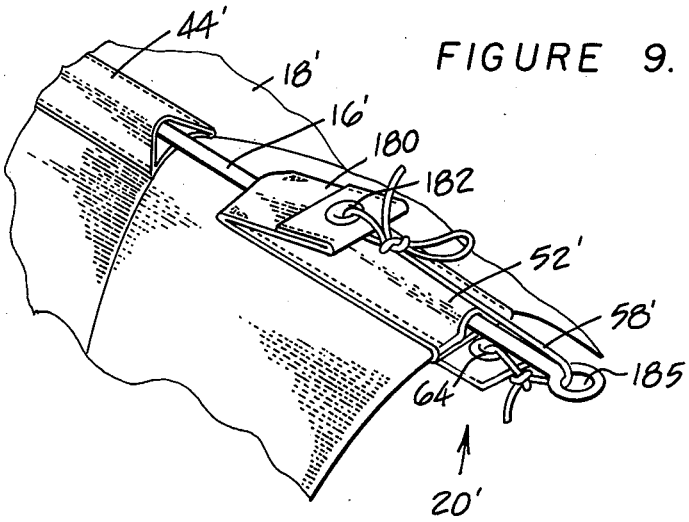
FIG. 9 is a detailed perspective view of an alternate tensioning device which may be used in both embodiments of this invention.

An alternate embodiment for the tensioning device is shown in FIG. 9. Like elements in FIG. 9 to the tensioning device shown in FIG. 12, are numbered with the same number with a prime. In FIG. 9, the fabric tunnel 52' is formed with a folded back flap 180, which is formed with a grommet 182 at the end thereof. In this embodiment, the tensioning 58' line is tied to the grommet 64 with the standing part passing through an eye 185 formed in the end of flexible ridge member 16'. It should be noted that the eye 185 may also be used to assist in fixing the tent to the terrain in the manner of the grommets 64 and 164. The line 58' is passed through the eye 185 and then through grommet 182. In the untied condition, the bitter end of the line 58' may then be pulled thus providing the user with a two fold purchase. When the tent is properly tensioned, a conventional hitch, such as a half hitch, or the like, may be passed around the standing part of the line 58' Grommeted holes 64 and 182 are formed on the line of the flexible ridge member 16'.

Finally it should be pointed out that the tents described herein may be readily adapted for display purposes by affixing a special material 188 to the tabs 42. The special material 188 has hook like protrusions formed thereupon and is sold under the trade name of VELCRO. This material 188 is particularly useful to sales personnel in displaying the tent on a carpeted surface. This material 188 will adhere tightly to the napped surface of a carpet thus sufficing as tie-down points for the tent. The material 188 is for use primarily on display models of the tent and is not appropriate for use in models of either embodiment which are to be used in the outdoor environment.

Finally it should be emphasized that the tubular material which forms, for example, the fabric tube 44 or the fabric tubes of 144 and 145 in the second embodiment, has been found particularly adaptable to this structure to eliminate or to at least lessen wear and tear on the outer cover during insertion and extraction of the flexible ridge members.

Although this invention is described in relation to two primary embodiments and several variations on elements in the tents, it is not be be considered so limited. The invention is only limited in so far as the limitations of the following claims.

What is claimed is:

1. A tent comprising:

an outer cover having at least two opposed edges on opposite sides thereof;

an inner cover;

a first arch assembly removably associated with the outer cover and adjacent one edge thereof;

a second arch assembly removably associated with the outer cover and adjacent an other edge thereof, said other edge of said outer cover generally opposite the one edge;

the apexes of said first and second arches generally at the midpoint at said one and the other edges respectively;

ridge means removably associated with and cooperating with said outer cover for spatially separating said first and said second arch assemblies in an outwardly diverging relation whereby said outer cover forms a shelter;

means for suspending said inner cover from said outer cover said ridge means comprising tension means for placing said outer cover under tension.

2. The tent as set forth in claim 1 wherein said ridge means comprises a flexible ridge member and said outer cover includes a tubed portion extending generally between the apexes of said first and said second arch assemblies, said flexible ridge member removably fixably positionable in said tubed portion, said flexible ridge member defining a portion extending outwardly of said tubed portion.

3. The tent as set forth in claim 2 wherein said flexible ridge member comprises a flexible metallic member.

4. The tent as set forth in claim 2 wherein said flexible ridge member defines an eye at the end extending outwardly of said tube portion.

5. The tent of claim 4 wherein said outer cover defines a pair of grommeted holes linearly separated and along the line at the flexible ridge member with one grommeted hole adjacent the eye of said ridge member; and wherein the tension means comprises an elongated flexible line affixed at one end to said one grommeted hole and extending through said eye and back through the other of said grommeted holes.

6. The tent as set forth in claim 1 further comprising third and fourth arch assemblies removably associated with said outer cover and adjacent third and fourth edges thereof respectively;

said third and fourth edges generally opposite one another and oriented 90° from said one and the other edges;

the apexes of said third and fourth arches generally at the midpoint of said third and fourth edges respectively;

a second ridge means removably associated with and cooperating with said cover for spatially separating said third and fourth arch assemblies in an outwardly diverging relation whereby said outer cover forms a generally octagonal shelter.

7. The tent as set forth in claim 6 wherein the means for suspending the inner cover from the outer cover comprises a web member, said web member stitched along one side to said outer cover and stitched along a second side thereof to said inner cover.

8. The tent as set forth in claim 7 wherein said web member is of netted material permitting air flow therethrough.

9. The tent as set forth in claim 8 of further comprising a floor affixed around the perimeter of said inner cover.

10. The tent as set forth in claim 9 further comprising a tab stitched to said tent at the intersection of the inner cover and the floor and generally coincident with each arch assembly, each tab having a grommeted hole therein;

each arch assembly comprising two legs, each leg defining a shoulder proximate the end thereof, said leg disposable in said grommeted hold of said tab so that the shoulder defined on the leg abuts the grommet.

11. The tent as set forth in claim 10 further comprising a fabric tube affixed to the outer cover for associating each ridge member with the outer cover.

12. The tent as set forth in claim 10 further defining a door opening in said inner cover;

the tent further comprising a slide fastener, and a door openingly and closingly associated with said door opening by said slide fastener.

13. The tent as set forth in claim 12 further comprising a netted portion formed in the inner cover proximate the apex of each arch structure.

14. The tent as set forth in claim 13 further comprising fabric fastening means affixed to the tabs for associating the tent with a carpeted display floor.

15. A double walled tent comprising at least two arch assemblies, a ridge member, and tension means, said ridge member associated with said outer cover, and means for suspending said inner cover from said outer cover; said tension means cooperating with said ridge member for tensioning said outer cover to separate said arch assemblies to form a shelter.

16. The tent as set forth in claim 15 wherein said means for suspending said inner cover comprises netted webbing.

17. The tent as set forth in claim 16 further comprising a third and a fourth arch assembly and a second ridge member, said third and fourth arch assemblies and said second ridge member oriented generally 90° from said first ridge member and said first and second arch assemblies.

18. The tent as set forth in claim 17 further comprising fabric tubes associated with said outer cover, said fabric tubes for receiving said ridge members.

19. The tent as set forth in claim 17 further comprising a floor member associated with perimeter of said inner cover.

20. The tent as set forth in claim 19 wherein said outer cover is formed of water proof material.

* * * * *

UNITED STATES PATENT OFFICE

CERTIFICATE OF CORRECTION

Patent No. 4,165,757 Dated August 28, 1979

Inventor(s) George R. Marks

It is certified that error appears in the above-identified patent and that said Letters Patent are hereby corrected as shown below:

| | |
|---|---|
| Column 1, Line 49 | change "are" to --use-- |
| Column 5, Line 60 | change "opposie" to --opposite-- |
| Column 7, Line 53 | change "52" to --42-- |
| Column 7, Line 68 | change "pair" to -- pairs --. |
| Column 9, Line 5 | change "to" to --by-- |
| Column 10, Line 27 | change "that" to --than-- |

Signed and Sealed this

Twentieth Day of November 1979

[SEAL]

Attest:

RUTH C. MASON
Attesting Officer

LUTRELLE F. PARKER
Acting Commissioner of Patents and Trademarks